US010376962B2

(12) United States Patent
Koubu et al.

(10) Patent No.: US 10,376,962 B2
(45) Date of Patent: Aug. 13, 2019

(54) METAL COMPOSITE POWDER AND METHOD FOR PRODUCING SAME

(71) Applicant: Dowa Electronics Materials Co., Ltd., Tokyo (JP)

(72) Inventors: Hiroaki Koubu, Tokyo (JP); Noriaki Nogami, Tokyo (JP)

(73) Assignee: Dowa Electronics Materials Co., Ltd., Tokyo (JP)

( * ) Notice: Subject to any disclaimer, the term of this patent is extended or adjusted under 35 U.S.C. 154(b) by 83 days.

(21) Appl. No.: 15/332,086

(22) Filed: Oct. 24, 2016

(65) Prior Publication Data

US 2017/0113277 A1 Apr. 27, 2017

(30) Foreign Application Priority Data

Oct. 26, 2015 (JP) ..... 2015-209929

(51) Int. Cl.

| | |
|---|---|
| ***B22F 9/14*** | (2006.01) |
| ***B22F 1/00*** | (2006.01) |
| ***B22F 1/02*** | (2006.01) |
| ***B22F 9/02*** | (2006.01) |
| ***C22C 9/00*** | (2006.01) |

(52) U.S. Cl.

CPC ..... *B22F 9/14* (2013.01); *B22F 1/0011* (2013.01); *B22F 1/0048* (2013.01); *B22F 1/0085* (2013.01); *B22F 1/025* (2013.01); *B22F 9/026* (2013.01); *C22C 9/00* (2013.01); *B22F 2202/13* (2013.01); *B22F 2998/10* (2013.01); *B22F 2999/00* (2013.01); *Y10T 428/12181* (2015.01)

(58) Field of Classification Search

None

See application file for complete search history.

(56) References Cited

U.S. PATENT DOCUMENTS

2009/0280326 A1* 11/2009 Giesenberg ..... B22F 1/0085 428/403

FOREIGN PATENT DOCUMENTS

| | | |
|---|---|---|
| JP | 2010077495 | 4/2010 |
| JP | 2010174311 | 8/2010 |

* cited by examiner

*Primary Examiner* — Daniel J. Schleis

(74) *Attorney, Agent, or Firm* — Bachman & LaPointe, PC

(57) ABSTRACT

After preparing a silver-coated copper powder wherein the surface of a copper powder having an average particle diameter of 0.1 to 100 μm is coated with silver, the silver-coated copper powder is sprayed into the tail flame region of a thermal plasma to cause silver on the surface of the copper powder to diffuse in the grain boundaries of copper on the inside of the copper powder, and thereafter, the surface of the copper powder is coated with silver to produce a metal composite powder wherein the percentage of the area occupied by silver on a cross section of the metal composite powder is 3 to 20% and wherein the surface thereof is coated with silver.

8 Claims, 10 Drawing Sheets

METAL COMPOSITE POWDER AND METHOD FOR PRODUCING SAME

BACKGROUND OF THE INVENTION

Field of the Invention

The present invention generally relates to a metal composite powder and a method for producing the same. More specifically, the invention relates to a metal composite powder for use in a conductive paste or the like, and a method for producing the same.

Description of the Prior Art

Conventionally, in order to form electrodes and wires of electronic parts by printing methods and so forth, there is used a conductive paste produced by mixing a solvent, a resin, a dispersant and so forth in a conductive metal powder, such as silver or copper powder.

However, silver powder is expensive since it is a powder of a noble metal although it has a very low volume resistivity to be a good conductive material. On the other hand, copper powder has an inferior storage stability (reliability) to that of silver powder since it is easily oxidized although it has a low volume resistivity to be a good conductive material.

In order to solve these problems, there is proposed a silver-coated copper powder, wherein the surface of copper powder is coated with silver, as a metal powder for use in a conductive paste (see, e.g., Japanese Patent Laid Open Nos. 2010-174311 and 2010-077495).

However, in the silver-coated copper powders disclosed in Japanese Patent Laid Open Nos. 2010-174311 and 2010-077495, if there is a portion of the surface of copper which is not coated with silver, oxidation proceeds from the portion, so that the storage stability (reliability) thereof is insufficient. In particular, since oxygen is easy to diffuse in grain boundaries, oxidation proceeds from the grain boundaries of copper by the diffusion (grain boundary diffusion) of oxygen along the grain boundaries of copper.

SUMMARY OF THE INVENTION

It is therefore an object of the present invention to eliminate the aforementioned problems and to provide a metal composite powder, which contains copper and silver and which is capable of improving the storage stability (reliability) thereof by preventing oxidation from proceeding from the surface thereof and the grain boundaries of copper, and a method for producing the same.

In order to accomplish the aforementioned and other objects, the inventors have diligently studied and found that it is possible to produce a metal composite powder, which is capable of improving the storage stability (reliability) thereof by preventing oxidation from proceeding from the surface thereof and the grain boundaries of copper, if a silver-coated copper powder, wherein the surface of a copper powder is coated with silver, is sprayed into a tail flame region of a thermal plasma to cause silver on the surface of the copper powder to diffuse in a grain boundary of copper on the inside of the copper powder, and thereafter, the surface of the copper powder is coated with silver. Thus, the inventors have made the present invention.

According to the present invention, there is provided a method for producing a metal composite powder, the method comprising the steps of: preparing a silver-coated copper powder wherein the surface of a copper powder is coated with silver; spraying the silver-coated copper powder into a tail flame region of a thermal plasma to cause silver on the surface of the copper powder to diffuse in a grain boundary of copper on the inside of the copper powder; and thereafter, coating the surface of the copper powder with silver.

In this method for producing a metal composite powder, the tail flame region of the thermal plasma preferably has a temperature of 2000 to 5000 K. The copper powder is preferably produced by atomizing. The copper powder preferably has an average particle diameter of 0.1 to 100 μm. The content of silver with respect to the silver-coated copper powder is preferably 5% by weight or more.

According to the present invention, there is provided a metal composite powder comprising: a copper powder; and silver diffusing in a grain boundary of copper on the inside of the copper powder and coating the surface of the copper powder. In this metal composite powder, the copper powder preferably has an average particle diameter of 0.1 to 100 μm. The content of silver with respect to the metal composite powder is preferably 5% by weight or more. The percentage of an area occupied by silver on a cross section of the metal composite powder is preferably 3 to 20%.

Throughout the specification, the expression "the average particle diameter of a copper powder" means the particle diameter ($D_{50}$ diameter) corresponding to 50% of accumulation in cumulative distribution of the copper powder, which is measured by a laser diffraction particle size analyzer.

According to the present invention, it is possible to provide a metal composite powder, which contains copper and silver and which is capable of improving the storage stability (reliability) thereof by preventing oxidation from proceeding from the surface thereof and the grain boundaries of copper, and a method for producing the same.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Figure 1:
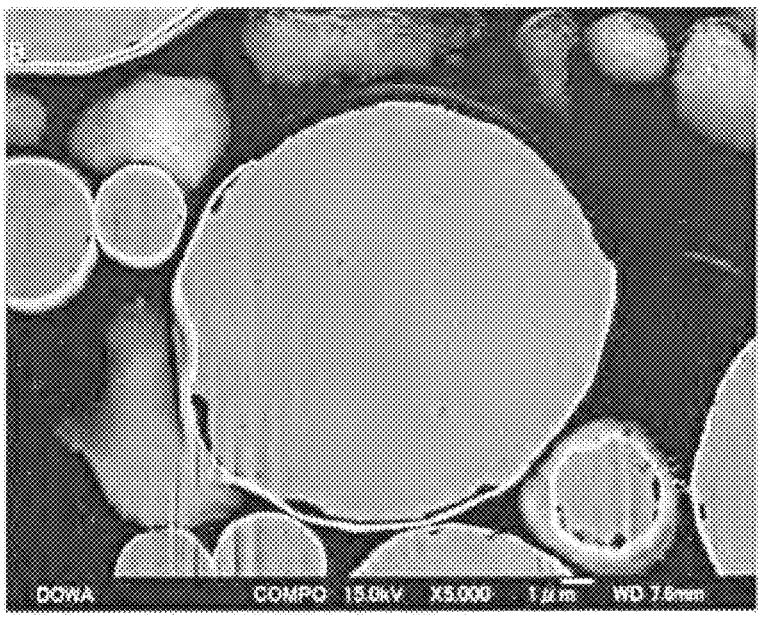
FIG. 1 is a compositional image in BE (Backscattered Electron) mode (COMPO image) obtained by observing a cross section of a silver-coated copper powder, which was obtained in Comparative Example 1, by means of a field emission scanning electron microscope (FE-SEM)

In a preferred embodiment of a method for producing a metal composite powder according to the present invention, a silver-coated copper powder, wherein the surface of a copper powder is coated with silver, is sprayed into a tail flame region of a thermal plasma to cause silver on the surface of the copper powder to diffuse in the grain boundaries of copper on the inside of the copper powder, and thereafter, the copper powder is coated with silver.

Although the copper powder used as a raw material may be produced by the wet reduction method, electrolysis method, vapor phase method or the like, it is preferably produced by a so-called atomizing method (such as a gas atomizing method or a water atomizing method) for producing a fine powder by rapidly cooling and solidifying copper, which is melted at a temperature of not lower than the melting temperature thereof, by causing a high-pressure gas or high-pressure water to collide with the melted copper while causing it to drop from the lower portion of a tundish. In particular, if the copper powder is produced by a so-called water atomizing method for spraying a high-pressure water, it is possible to obtain a copper powder having a small particle diameter, so that it is possible to improve the electric conductivity of an electrically conductive paste due to the increase of the number of contact points between the particles of the copper powder when the copper powder is used for preparing the electrically conductive paste.

The average particle diameter of the copper powder is preferably in the range of from 0.1 μm to 100 μm, more preferably in the range of from 0.5 μm to 20 μm, and most preferably in the range of from 1 μm to 10 μm. If the average particle diameter of the copper powder is less than 0.1 μm, it is not preferable since it has a bad influence on the electric conductivity of the silver-coated copper powder. On the other hand, if the average particle diameter of the copper powder exceeds 100 μm, it is not preferable since it is difficult to form fine wires.

As a method for coating the copper powder with silver, there may be used a method for depositing silver on the surface of the copper powder by a substitution method utilizing a substitution reaction for substituting silver for copper or by a reduction method using a reducing agent. For example, there may be used a method for depositing silver on the surface of the copper powder while stirring a solution containing the copper powder and silver ions in a solvent, or a method for depositing silver on the surface of the copper powder while stirring a mixed solution of a solution containing the copper powder and an organic matter in a solvent and a solution containing silver ions and an organic matter in a solvent.

As the solvent, there may be used water, an organic solvent or a mixed solvent thereof. If a solvent prepared by mixing water with an organic solvent is used, it is required to use an organic solvent which is liquid at room temperature (20 to 30° C.), and the mixing ratio of water to the organic solvent may be suitably adjusted in accordance with the used organic solvent. As water used as the solvent, there may be used distilled water, ion-exchanged water, industrial water or the like unless there is the possibility that impurities are mixed therein.

As raw materials of silver, silver nitrate having a high solubility with respect to water and many organic solvents is preferably used since it is required to cause silver ions to exist in a solution. In order to carry out a reaction for coating the copper powder with silver (silver coating reaction) as uniform as possible, a silver nitrate solution, which is prepared by dissolving silver nitrate in a solvent (water, an organic solvent or a mixed solvent thereof), not solid silver nitrate, is preferably used. The amount of the used silver nitrate solution, the concentration of silver nitrate in the silver nitrate solution, and the amount of the organic solvent may be determined in accordance with the amount of the intended silver containing layer.

In order to more uniformly form silver, a chelating agent may be added to the solution. As the chelating agent, there is preferably used a chelating agent having a high complex stabilization constant with respect to copper ions and so forth, so as to prevent the reprecipitation of copper ions and so forth, which are formed as vice-generative products by a substitution reaction for substituting silver ions for metallic copper. In particular, the chelating agent is preferably selected in view of the complex stabilization constant with respect to copper since the copper powder serving as the core of the silver-coated copper powder contains copper as a main composition element. Specifically, as the chelating agent, there may be used a chelating agent selected from the group consisting of ethylene-diamine-tetraacetic acid (EDTA), iminodiacetic acid, diethylene-triamine, triethylene-diamine, and salts thereof.

In order to stably and safely carry out the silver coating reaction, a buffer for pH may be added to the solution. As the buffer for pH, there may be used ammonium carbonate, ammonium hydrogen carbonate, ammonia water, sodium hydrogen carbonate or the like.

When the silver coating reaction is carried out, a solution containing a silver salt is preferably added to a solution in which the copper powder is sufficiently dispersed by stirring the solution after the copper powder is put therein before the silver salt is added thereto. The reaction temperature in the silver coating reaction may be a temperature at which the solidification or evaporation of the reaction solution is not caused. The reaction temperature is set to be preferably 10 to 40° C. and more preferably 15 to 35° C. The reaction time may be set in the range of from 1 minute to 5 hours although it varies in accordance with the amount of the coating silver and the reaction temperature.

The content (coating amount) of silver with respect to the silver-coated copper powder is preferably 5% by weight or more, more preferably in the range of from 7% by weight to 50% by weight, more preferably in the range of from 8% by weight to 40% by weight, and most preferably in the range of from 9% by weight to 20% by weight. If the content of silver is less than 5% by weight, it is not preferable since it has a bad influence on the electric conductivity of the silver-coated copper powder. On the other hand, if the content of silver exceeds 50% by weight, it is not preferable since the costs thereof are high due to the increase of the amount of silver to be used.

The silver-coated copper powder thus obtained is sprayed into the tail flame region of a thermal plasma to be heat-treated to cause silver on the surface of the copper powder to diffuse in the grain boundaries of copper on the inside of the copper powder. Since plasma flames use clean gases, there is no possibility that impurities are adhered to the silver-coated copper powder sprayed into the tail flame of the thermal plasma. The period of time for applying heat to the silver-coated copper powder by the tail flame region of the thermal plasma is a short period of time, so that it is possible to prevent the aggregation of the silver-coated copper powder.

In a typical method for utilizing a thermal plasma to produce ultrafine particles (nanoparticles) by feeding a raw material directly into a plasma flame, the raw material is instantly heated to thousands degrees Celsius in a high temperature region of not less than 10,000° C. of the plasma flame to be decomposed to atoms and/or radicals to be rapidly cooled to about 1,000° C., at which a homogeneous nucleation occurs, in a downstream low-temperature region to synthesize ultrafine particles. However, in the preferred embodiment of a method for producing a metal composite powder according to the present invention, the silver-coated copper powder is fed into the plasma tail flame region having a temperature of 2000 to 5000 K, so that silver having a lower melting point than that of copper is melted to diffuse while the silver-coated copper powder is caused to pass through the plasma tail flame region in a very short period of time. Therefore, it is possible to cause silver on the surface of the copper powder to diffuse in the grain boundaries of copper on the inside of the copper powder while the shape of the copper powder serving as the core of the silver-coated copper powder is maintained to some extent. Furthermore, silver on the surface of the copper powder is preferably caused to diffuse in the grain boundaries of copper on the inside of the copper powder to one-third or more the particle diameter of the copper powder from the surface of the copper powder, and more preferably caused to diffuse in the whole grain boundaries of copper on the inside of the copper powder.

The spraying of the silver-coated copper powder into the tail flame region of the thermal plasma may be carried out by means of a thermal plasma apparatus. In order to feed the silver-coated copper powder into the tail flame region of the thermal plasma having a temperature of 2000 to 5000 K by means of the thermal plasma apparatus, the output of the plasma apparatus is preferably 2 to 10 kW, more preferably 4 to 8 kW, and most preferably 5 to 7 kW. The flow rate of argon gas for plasma is preferably 5 to 40 L/min, and more preferably 15 to 25 L/min. The flow rate of carrier nitrogen gas for supplying the silver-coated copper powder is preferably 0 to 3 L/min, and more preferably 0 to 0.5 L/min. The pressure in the apparatus is preferably 0 to 100 kPa, and more preferably 50 to 100 kPa. The amount of the silver-coated copper powder to be supplied is preferably 0.1 to 400 g/min, and more preferably 100 to 400 g/min.

After silver on the surface of the copper powder is thus caused to diffuse in the grain boundaries of copper on the inside of the copper powder, the surface (of the obtained metal composite powder) (at least the exposed surface of the copper powder) is coated with silver. As the method for coating the surface with silver, there may be used the same method as the above-described method for coating the surface of the copper powder with silver.

In the above-described preferred embodiment of a method for producing a metal composite powder according to the present invention, it is possible to produce a metal composite powder wherein silver diffuses in the grain boundaries of copper on the inside of a copper powder and wherein the surface thereof is coated with silver. The content of silver with respect to the metal composite powder may be 5% by weight or more (preferably 7 to 50% by weight, more preferably 8 to 40% by weight, and most preferably 9 to 20% by weight). The percentage of an area occupied by silver on a cross section of the metal composite powder may be 3 to 20% (preferably 8 to 20%).

In the grain boundaries, the arrangement of crystals falls into disorder, and oxygen is easy to diffuse, so that oxidation proceeds from the grain boundaries of copper by the diffusion (grain boundary diffusion) of oxygen along the grain boundaries of copper. However, in the metal composite powder according to the present invention, silver is caused to diffuse in the grain boundaries of copper on the inside of the copper powder to be filled in the grain boundaries of copper on the inside of the copper powder, and thereafter, the surface of the copper powder is coated with silver. Therefore, it is possible to suppress oxidation from the surface thereof and the grain boundaries of copper, so that it is possible to provide a metal composite powder having a high oxidation resistance.

Furthermore, the metal composite powder (the metal composite powder, the surface of which is coated with silver) produced by the above-described preferred embodiment of a method for producing a metal composite powder according to the present invention may be added to a silver supporting solution, such as a silver potassium cyanide solution, to cause silver to be supported on the surface of the metal composite powder. If silver is thus supported on the surface of the metal composite powder, even if the copper powder is exposed on a portion of the surface of the metal composite powder (the metal composite powder, the surface of which is coated with silver), the exposed portion of the copper powder (which is not coated with silver) can be coated with silver, so that it is possible to provide a metal composite powder having a higher oxidation resistance.

Examples of a metal composite powder and a method for producing the same according to the present invention will be described below in detail.

Comparative Example 1

There was prepared a commercially available copper powder produced by atomizing (spherical atomized copper powder produced by Nippon Atomized Metal Powders Corporation, the copper powder having a purity of 99.9% by weight and an average particle diameter of 5 μm).

There were also prepared a solution (solution 1) obtained by dissolving 2.6 kg of ammonium carbonate in 450 kg of pure water, and a solution (solution 2) obtained by adding 92 kg of an aqueous silver nitrate solution containing 16.904 kg of silver to a solution obtained by dissolving 319 kg of EDTA-4Na (43%) and 76 kg of ammonium carbonate in 284 kg of pure water.

Then, in the atmosphere of nitrogen, 100 kg of the above-described copper powder was added to the solution 1, and the temperature of the solution was raised to 35° C. while stirring the solution. Then, the solution 2 was added to the solution containing copper powder dispersed therein, and was stirred for 30 minutes.

Thereafter, a solid content obtained by filtration was washed with ion-exchanged water until a transparent filtrate was obtained, and then, the washed solid content was vacuum-dried at 70° C. to obtain a copper powder coated with silver (a silver-coated copper powder).

After a cross section of the silver-coated copper powder thus obtained was produced by a cross section polisher (CP), the cross section was observed by means of a field emission scanning electron microscope (FE-SEM). The compositional image in BE mode (COMPO image) of the cross section of the silver-coated copper powder in this observation is shown in FIG. 1. In this COMPO image, since brightness is lighter as atomic weight is larger, silver appears to be lighter than copper, so that the relatively light portion of brightness corresponds to silver and the dark portion thereof corresponds to copper. It can be seen from the COMPO image that the copper powder is coated with silver in the silver-coated copper powder obtained in this comparative example. Furthermore, the black lines observed on the inside of the copper powder serving as the core of the silver-coated copper powder show the grain boundaries of copper.

Figure 11:
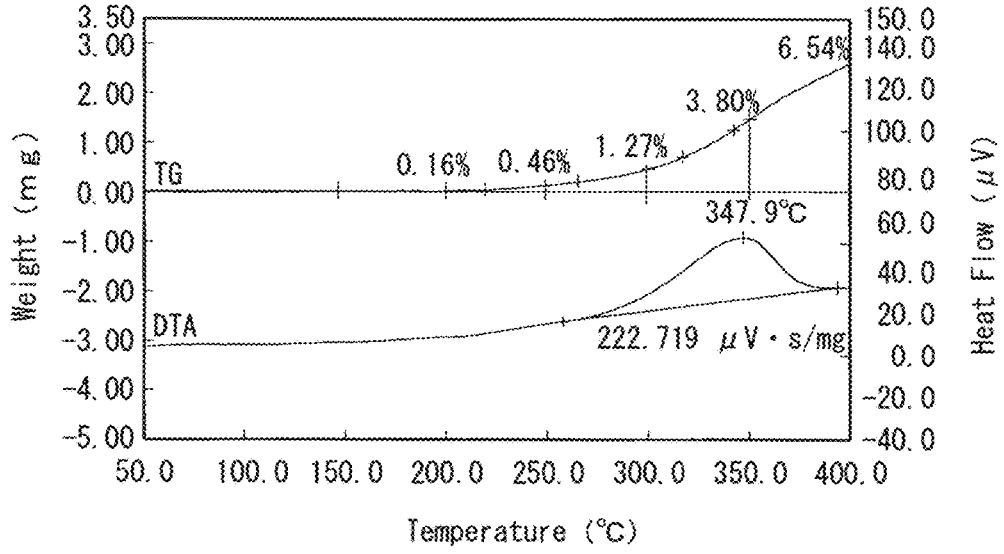
FIG. 11 is a chart showing the measured results in the TG-DTA of the silver-coated copper powder obtained in Comparative Example 1.

Then, a thermogravimetry/differential thermal analyzer (TG-DTA apparatus) (Thermo Plus EVO2 TG-8120 produced by Rigaku Co., Ltd.) was used for carrying out the TG-DTA measurement of 40 mg of the silver-coated copper powder, which was distributed from the obtained silver-coated copper powder, by raising the temperature thereof at a rate of temperature increase of 10° C./min from room temperature (25° C.) to 400° C. while causing air to flow at a flow rate of 200 mL/min therein. The measured results thereof are shown in FIG. 11. On the basis of a rate (%) of weight increase obtained from a difference (the weight increased by heating) between each of weights of the silver-coated copper powder obtained at temperatures of 200° C., 250° C., 300° C., 350° C. and 400° C. in this measurement and the weight of the silver-coated copper powder before heating, with respect to the weight of the silver-coated copper powder before heating, the storage stability (reliability) of the silver-coated copper powder was evaluated by evaluating the high-temperature stability (with respect to oxidation) of the silver-coated copper powder in air, assuming that all of the weights increased by heating were weights increased by oxidation of the silver-coated copper powder. As a result, the rates of weight increase at 200° C., 250° C., 300° C., 350° C. and 400° C. were 0.16%, 0.46%, 1.27%, 3.80% and 6.54%, respectively. In the TG-DTA measurement of the silver-coated copper powder obtained in this comparative example, an exothermic peak (with increase in weight due to oxidation) appeared.

The COMPO image of the cross section of the silver-coated copper powder shown in FIG. 1 and a particle analyzing software (Region Adviser produced by SYSTEM IN FRONTIER INC.) were used for carrying out the image analysis of the cross section of the silver-coated copper powder in this comparative example. In this image analysis, after the date smoothing of the COMPO image was carried out, the contrast thereof was set to be 100 and the brightness thereof was controlled between 60 and 100 in an automatic contrast/brightness controlling portion (ACB), and a binary coded processing in a histogram system (a processing for constructing a histogram of brightness values on the image to binarize the image on the basis of the tendency of the histogram) was carried out by a region segmentation. As a result, the percentage of silver with respect to the whole cross-sectional area of the silver-coated copper powder (the amount of silver on the cross section) was 3.85% which was smaller than the content of silver (11.06%). Furthermore, the content of silver in the silver-coated copper powder in this comparative example was obtained as follows. First, 5.0 g of the silver-coated copper powder was added to 40 mL of an aqueous nitric acid solution prepared by diluting an aqueous nitric acid solution having a specific gravity of 1.38 with pure water at a volume ratio of 1:1, and the solution was boiled by a heater to completely dissolve the silver-coated copper powder therein. Thereafter, an aqueous hydrochloric acid solution prepared by diluting an aqueous hydrochloric acid solution having a specific gravity of 1.18 with pure water at a volume ratio of 1:1 was added to the above-described aqueous solution, in which the silver-coated copper powder was completely dissolved, little by little to deposit silver chloride, and the aqueous hydrochloric acid solution was added until no precipitates of silver chloride were produced. The content of silver was calculated from the weight of obtained silver chloride to obtain the content of silver in the silver-coated copper powder.

Comparative Example 2

The silver-coated copper powder obtained in Comparative Example 1 was sprayed into the tail flame region of a thermal plasma by means of a thermal plasma apparatus (Nanoparticle Synthesis Experimental Apparatus produced by JEOL Ltd.) to be heat-treated to obtain a metal composite powder. This plasma tail flame region was purple, so that it can be determined that the temperature thereof was 3000 to 5000 K. In this process, the output of the thermal plasma apparatus was 6 kW. The flow rate of argon gas for plasma was 20 L/min, and the flow rate of carrier nitrogen gas for supplying the silver-coated copper powder was 2 L/min. The pressure in the apparatus was 50 kPa, and the amount of the silver-coated copper powder to be supplied was 2.5 g/min.

Figure 2:
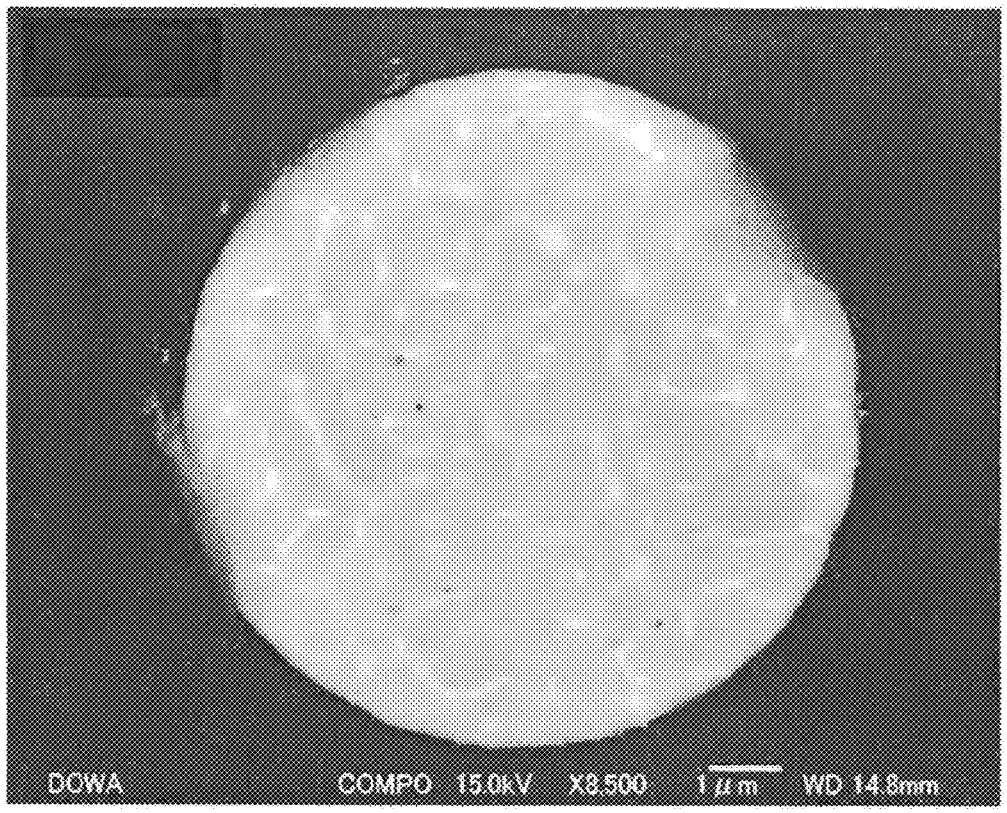
FIG. 2 is a COMPO image obtained by observing a cross section of a metal composite powder, which was obtained in Comparative Example 2, by means of the FE-SEM.

After a cross section of the metal composite powder thus obtained was produced by the cross section polisher (CP), the cross section was observed by means of the field emission scanning electron microscope (FE-SEM). The COMPO image of the cross section of the metal composite powder in this observation is shown in FIG. 2. It can be seen from this COMPO image that silver is caused to diffuse in the grain boundaries of copper although the surface of the copper powder is not coated with silver, in the metal composite powder obtained in this comparative example.

Figure 3:
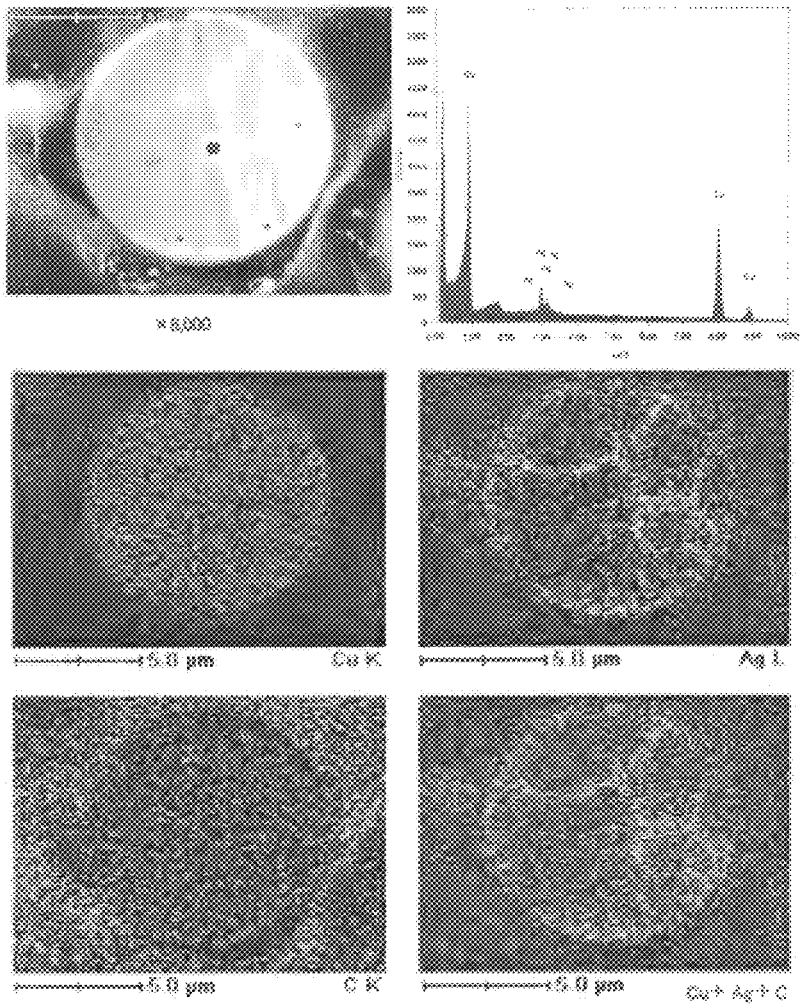
FIG. 3 is a mapping image obtained by observing the cross section of the metal composite powder, which was obtained in Comparative Example 2, by means of an energy dispersive X-ray spectrometer (EDS) and a field emission Auger electron spectrometer (FE-AES)

Then, the cross section of the metal composite powder obtained in this comparative example was observed by means of an energy dispersive X-ray spectrometer (EDS) and a field emission Auger electron spectrometer (FE-AES). The mapping image of the cross section of the metal composite powder in this observation is shown in FIG. 3. It can be also seen from this mapping image that silver is caused to diffuse in the grain boundaries of copper.

Figure 12:
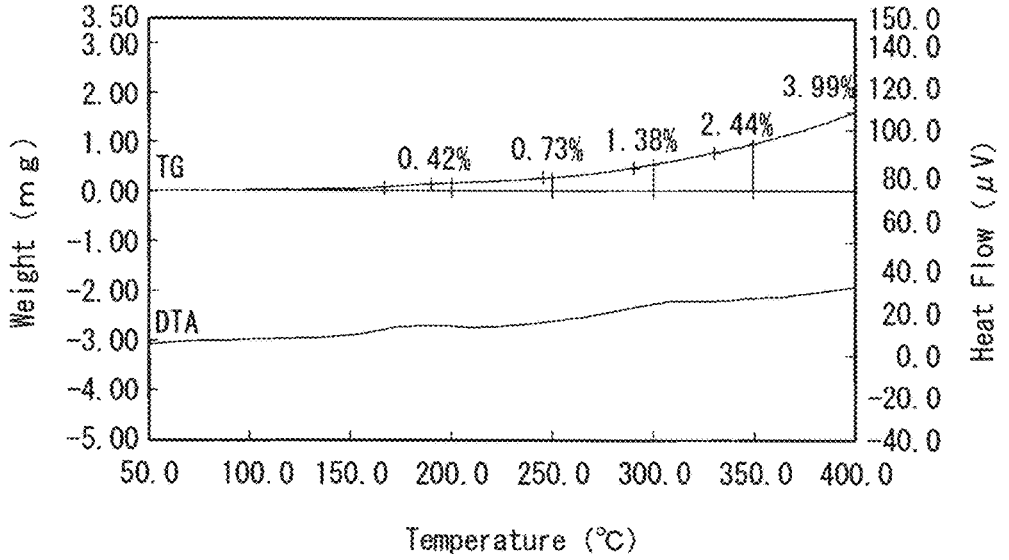
FIG. 12 is a chart showing the measured results in the TG-DTA of the metal composite powder obtained in Comparative Example 2.

With respect to the obtained metal composite powder, the TG-DTA measurement was carried out by the same method as that in Comparative Example 1. The measured results thereof are shown in FIG. 12. On the basis of a rate (%) of weight increase obtained from a difference (the weight increased by heating) between each of weights of the metal composite powder obtained at temperatures of 200° C., 250° C., 300° C., 350° C. and 400° C. in this measurement and the weight of the metal composite powder before heating, with respect to the weight of the metal composite powder before heating, the storage stability (reliability) of the metal composite powder was evaluated by evaluating the high-temperature stability (with respect to oxidation) of the metal composite powder in air, assuming that all of the weights increased by heating were weights increased by oxidation of the metal composite powder. As a result, the rates of weight increase at 200° C., 250° C., 300° C., 350° C. and 400° C. were 0.42%, 0.73%, 1.38%, 2.44% and 3.99%, respectively. It can be seen from these results that the high-temperature stability (with respect to oxidation) of the metal composite powder in air is improved, so that the storage stability (reliability) of the metal composite powder is improved, since the rates of weight increase at high temperatures in the metal composite powder obtained in this comparative example are smaller than those in the silver-coated copper powder obtained in Comparative Example 1. Furthermore, in the TG-DTA measurement of the metal composite powder obtained in this comparative example, no exothermic peak (with increase in weight due to oxidation) appeared.

The COMPO image of the cross section of the metal composite powder shown in FIG. 2 and the particle analyzing software (Region Adviser produced by SYSTEM IN FRONTIER INC.) were used for carrying out the image analysis of the cross section of the metal composite powder in this comparative example. As a result, the percentage of silver with respect to the whole cross-sectional area of the metal composite powder (the amount of silver on the cross section) was 12.00% which was larger than the content of silver (10.92%). Furthermore, the content of silver in the metal composite powder in this comparative example was obtained as follows. First, 0.5 g of the metal composite powder was added to 5 mL of an aqueous nitric acid solution prepared by diluting an aqueous nitric acid solution having a specific gravity of 1.38 with pure water at a volume ratio of 1:1, and the solution was boiled by a heater to completely dissolve the metal composite powder therein. Thereafter, a filtrate obtained by filtration was caused to have a constant volume by adding pure water thereto, and the content of silver in the metal composite powder was obtained by quantitative analysis by means of an inductively coupled plasma (ICP) emission spectrophotometric analyzer (iCAP 6300 produced by Thermo Scientific).

Comparative Example 3

Figure 4:
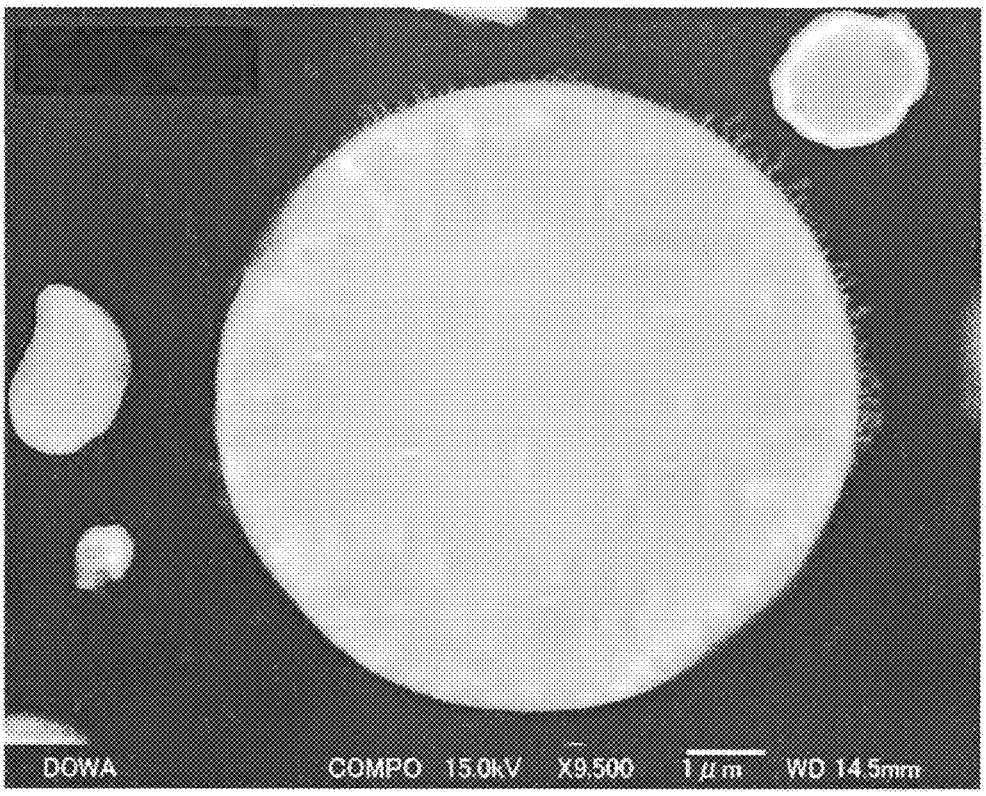
FIG. 4 is a COMPO image obtained by observing a cross section of a metal composite powder, which was obtained in Comparative Example 3, by means of the FE-SEM.

A metal composite powder was obtained by the same method as that in Comparative Example 2, except that the output of the thermal plasma apparatus was 2 kW (in this case, the plasma tail flame was green, so that it can be determined that the temperature of the plasma tail flame was a lower temperature (2000 to 4000 K) than 3000 to 5000 K which was the temperature thereof when the output of the thermal plasma apparatus was 6 kW). Then, a cross section of the obtained metal composite powder was produced by the cross section polisher (CP), and the cross section was observed by means of the field emission scanning electron microscope (FE-SEM). The COMPO image of the cross section of the metal composite powder in this observation is shown in FIG. 4. It can be seen from this COMPO image that silver is caused to diffuse in part of the grain boundaries of copper on the inside of the copper powder in the metal composite powder obtained in this comparative example.

Figure 13:
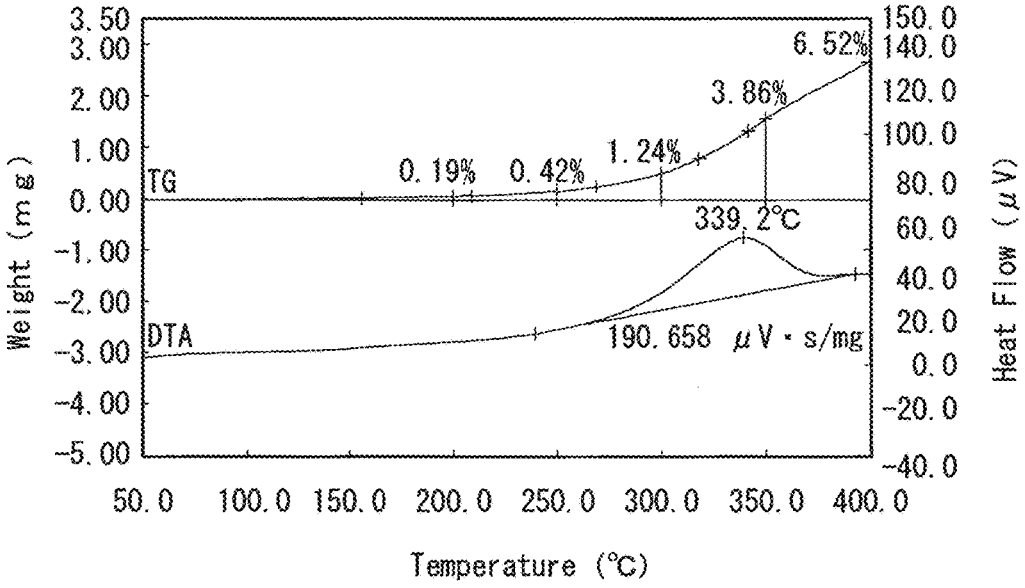
FIG. 13 is a chart showing the measured results in the TG-DTA of the metal composite powder obtained in Comparative Example 3.

With respect to the obtained metal composite powder, the TG-DTA measurement was carried out by the same method as that in Comparative Example 1. The measured results thereof are shown in FIG. 13. On the basis of a rate (%) of weight increase obtained from a difference (the weight increased by heating) between each of weights of the metal composite powder obtained at temperatures of 200° C., 250° C., 300° C., 350° C. and 400° C. in this measurement and the weight of the metal composite powder before heating, with respect to the weight of the metal composite powder before heating, the storage stability (reliability) of the metal composite powder was evaluated by evaluating the high-temperature stability (with respect to oxidation) of the metal composite powder in air, assuming that all of the weights increased by heating were weights increased by oxidation of the metal composite powder. As a result, the rates of weight increase at 200° C., 250° C., 300° C., 350° C. and 400° C. were 0.19%, 0.42%, 1.24%, 3.86% and 6.52%, respectively. It can be seen from these results that the storage stability (reliability) of the metal composite powder obtained in this comparative example are not greatly varied in comparison with that of the silver-coated copper powder obtained in Comparative Example 1. Furthermore, in the TG-DTA measurement of the metal composite powder obtained in this comparative example, an exothermic peak (with increase in weight due to oxidation) appeared.

The COMPO image of the cross section of the metal composite powder shown in FIG. 4 and the particle analyzing software (Region Adviser produced by SYSTEM IN FRONTIER INC.) were used for carrying out the image analysis of the cross section of the metal composite powder in this comparative example. As a result, the percentage of silver with respect to the whole cross-sectional area of the metal composite powder (the amount of silver on the cross section) was 11.56% which was larger than the content of silver (10.90%) (which was obtained by the same method as that in Comparative Example 2).

Example 1

There were prepared a solution (solution 1) obtained by dissolving 21.00 g of EDTA-4Na (43%) and 5.00 g of ammonium carbonate in 32.40 g of pure water, and a solution (solution 2) obtained by adding 3.45 g of an aqueous silver nitrate solution containing 1.11 g of silver to a solution obtained by dissolving 21.00 g of EDTA-4Na (43%) and 5.00 g of ammonium carbonate in 32.40 g of pure water.

Then, in the atmosphere of nitrogen, 10.00 g of the metal composite powder obtained in Comparative Example 2 was added to the solution 1, and the temperature of the solution was raised to 35° C. while stirring the solution. Then, the solution 2 was added to the solution containing copper powder dispersed therein, and was stirred for 30 minutes.

Thereafter, a solid content obtained by filtration was washed with ion-exchanged water until a transparent filtrate was obtained, and then, the washed solid content was vacuum-dried at 70° C. to obtain a metal composite powder coated with silver.

Figure 5:
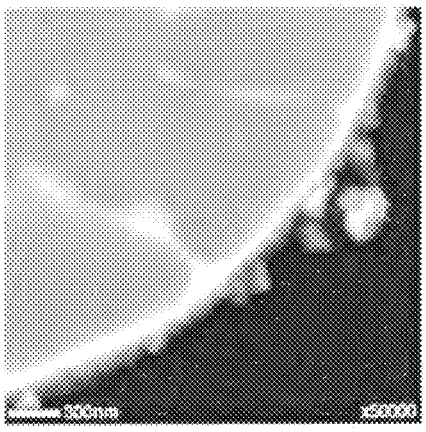
FIG. 5 is a COMPO image obtained by observing a cross section of a metal composite powder, which was obtained in Example 1, by means of the FE-SEM.

After a cross section of the metal composite powder thus obtained was produced by the cross section polisher (CP), the cross section was observed by means of the field emission scanning electron microscope (FE-SEM). The COMPO image of the cross section of the metal composite powder in this observation is shown in FIG. 5. It can be seen from this COMPO image that silver is caused to diffuse in the grain boundaries of copper on the inside of the copper powder while the surface of the copper powder is coated with silver, in the metal composite powder obtained in this example.

Figure 6:
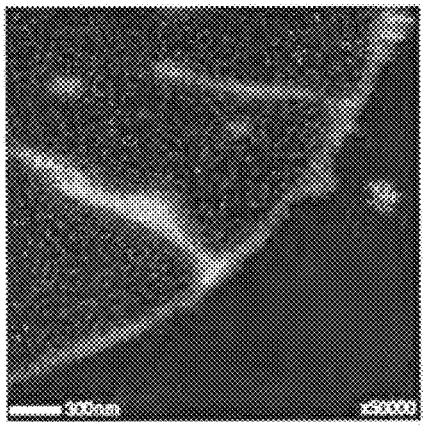
FIG. 6 is a silver mapping image obtained by observing the cross section of the metal composite powder, which was obtained in Example 1, by means of the FE-SEM.
Figure 7:
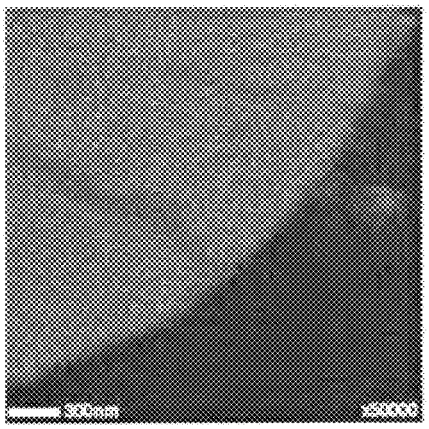
FIG. 7 is a copper mapping image obtained by observing the cross section of the metal composite powder, which was obtained in Example 1, by means of the FE-SEM.

Then, the cross section of the metal composite powder obtained in this example was observed by means of the energy dispersive X-ray spectrometer (EDS) and the field emission Auger electron spectrometer (FE-AES). The silver mapping image of the cross section of the metal composite powder in this observation is shown in FIG. 6, and the copper mapping image thereof is shown in FIG. 7. It can be also seen from these mapping images that silver is caused to diffuse in the grain boundaries of copper on the inside of the copper powder while the surface of the copper powder is coated with silver.

Figure 14:
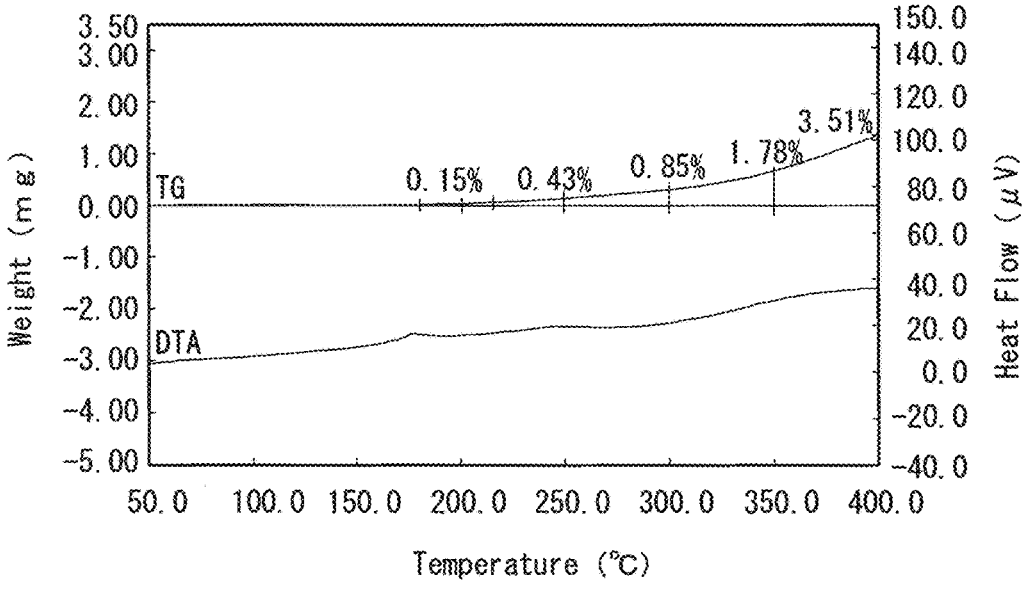
FIG. 14 is a chart showing the measured results in the TG-DTA of the metal composite powder obtained in Example 1.

With respect to the obtained metal composite powder, the TG-DTA measurement was carried out by the same method as that in Comparative Example 1. The measured results thereof are shown in FIG. 14. On the basis of a rate (%) of weight increase obtained from a difference (the weight increased by heating) between each of weights of the metal composite powder obtained at temperatures of 200° C., 250° C., 300° C., 350° C. and 400° C. in this measurement and the weight of the metal composite powder before heating, with respect to the weight of the metal composite powder before heating, the storage stability (reliability) of the metal composite powder was evaluated by evaluating the high-temperature stability (with respect to oxidation) of the metal composite powder in air, assuming that all of the weights increased by heating were weights increased by oxidation of the metal composite powder. As a result, the rates of weight increase at 200° C., 250° C., 300°, 350° C. and 400° C. were 0.15%, 0.43%, 0.85%, 1.78% and 3.51%, respectively. It can be seen from these results that the high-temperature stability (with respect to oxidation) of the metal composite powder in air is improved, so that the storage stability (reliability) of the metal composite powder is improved, since the rates of weight increase in the metal composite powder obtained in this example are smaller than those in the silver-coated copper powder obtained in Comparative Example 1 and in the metal composite powders obtained in the Comparative Examples 2 and 3. Furthermore, in the TG-DTA measurement of the metal composite powder obtained in this example, no exothermic peak (with increase in weight due to oxidation) appeared.

The COMPO image of the cross section of the metal composite powder shown in FIG. 5 and the particle analyzing software (Region Adviser produced by SYSTEM IN FRONTIER INC.) were used for carrying out the image analysis of the cross section of the metal composite powder in this example. As a result, the percentage of silver with respect to the whole cross-sectional area of the metal composite powder (the amount of silver on the cross section) was 15.05% which was smaller than the content of silver (22.72%) (which was obtained by the same method as that in Comparative Example 2).

Example 2

A metal composite powder coated with silver was obtained by the same method at that in Example 1, except that the metal composite powder obtained in Comparative Example 3 was substituted for the metal composite powder obtained in Comparative Example 2.

Figure 8:
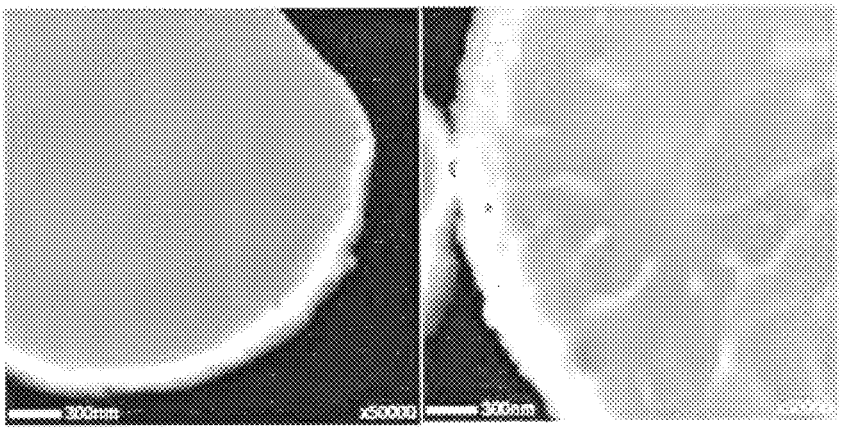
FIG. 8 is a COMPO image obtained by observing a cross section of a metal composite powder, which was obtained in Example 2, by means of the FE-SEM.

After a cross section of the metal composite powder thus obtained was produced by the cross section polisher (CP), the cross section was observed by means of the field emission scanning electron microscope (FE-SEM). The COMPO image of the cross section of the metal composite powder in this observation is shown in FIG. 8. It can be seen from this COMPO image that silver is caused to diffuse in part of the grain boundaries of copper on the inside of the copper powder while the surface of the copper powder is coated with silver, in the metal composite powder obtained in this example.

Figure 9:
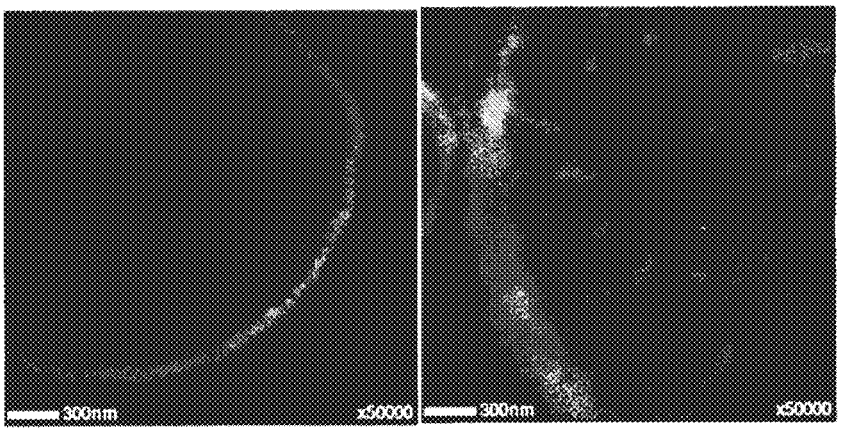
FIG. 9 is a silver mapping image obtained by observing the cross section of the metal composite powder, which was obtained in Example 2, by means of the FE-SEM.
Figure 10:
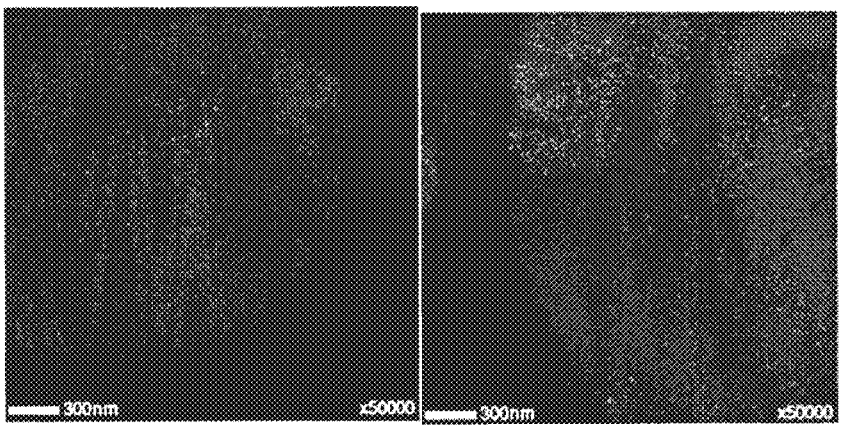
FIG. 10 is a copper mapping image obtained by observing the cross section of the metal composite powder, which was obtained in Example 2, by means of the FE-SEM.

Then, the cross section of the metal composite powder obtained in this example was observed by means of the energy dispersive X-ray spectrometer (EDS) and the field emission Auger electron spectrometer (FE-AES). The silver mapping image of the cross section of the metal composite powder in this observation is shown in FIG. 9, and the copper mapping image thereof is shown in FIG. 10. It can be also seen from these mapping images that silver is caused to diffuse in part of the grain boundaries of copper on the inside of the copper powder while the surface of the copper powder is coated with silver.

Figure 15:
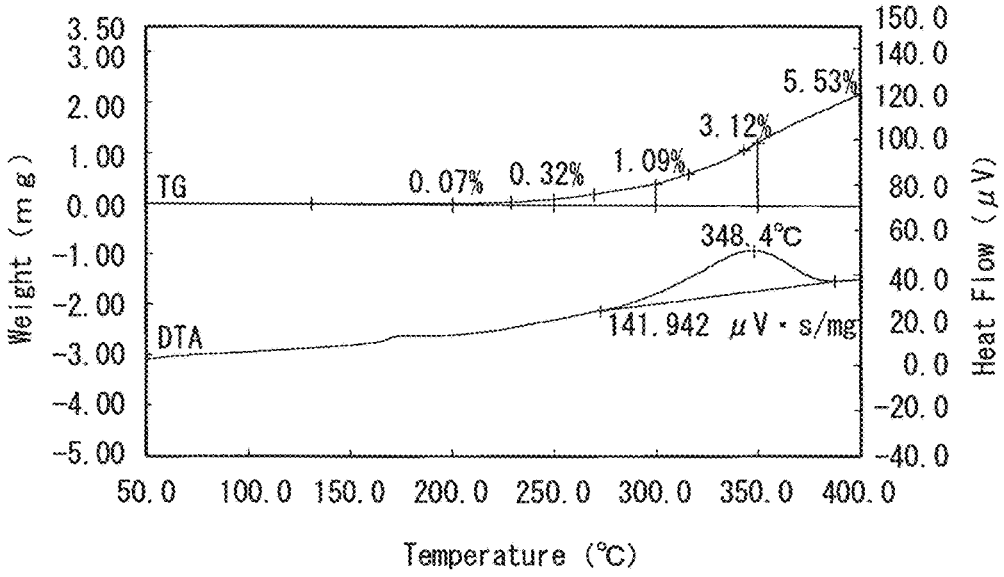
FIG. 15 is a chart showing the measured results in the TG-DTA of the metal composite powder obtained in Example 2.

With respect to the obtained metal composite powder, the TG-DTA measurement was carried out by the same method as that in Comparative Example 1. The measured results thereof are shown in FIG. 15. On the basis of a rate (%) of weight increase obtained from a difference (the weight increased by heating) between each of weights of the metal composite powder obtained at temperatures of 200° C., 250° C., 300° C., 350° C. and 400° C. in this measurement and the weight of the metal composite powder before heating, with respect to the weight of the metal composite powder before heating, the storage stability (reliability) of the metal composite powder was evaluated by evaluating the high-temperature stability (with respect to oxidation) of the metal composite powder in air, assuming that all of the weights increased by heating were weights increased by oxidation of the metal composite powder. As a result, the rates of weight increase at 200° C., 250° C., 300° C., 350° C. and 400° C. were 0.07%, 0.32%, 1.09%, 3.12% and 5.53%, respectively. It can be seen from these results that the high-temperature stability (with respect to oxidation) of the metal composite powder in air is improved, so that the storage stability (reliability) of the metal composite powder is improved, since the rates of weight increase in the metal composite powder obtained in this example are smaller than those in the silver-coated copper powder obtained in Comparative Example 1 and in the metal composite powder obtained in the Comparative Example 3. Furthermore, in the TG-DTA measurement of the metal composite powder obtained in this example, an exothermic peak (with increase in weight due to oxidation) appeared.

The COMPO image of the cross section of the metal composite powder shown in FIG. 8 and the particle analyzing software (Region Adviser produced by SYSTEM IN FRONTIER INC.) were used for carrying out the image analysis of the cross section of the metal composite powder in this example. As a result, the percentage of silver with respect to the whole cross-sectional area of the metal composite powder (the amount of silver on the cross section) was 12.05% which was smaller than the content of silver (19.84%) (which was obtained by the same method as that in Comparative Example 2).

Comparative Example 4

There were prepared a solution (solution 1) obtained by dissolving 112.61 g of EDTA-4Na (43%) and 9.10 g of ammonium carbonate in 1440.89 g of pure water, and a solution (solution 2) obtained by adding 255.68 g of an aqueous silver nitrate solution containing 82.1 g of silver to a solution obtained by dissolving 1551.67 g of EDTA-4Na (43%) and 185.29 g of ammonium carbonate in 407.95 g of pure water.

Then, in the atmosphere of nitrogen, 350 g of the same copper powder as that in Comparative Example 1 was added to the solution 1, and the temperature of the solution was raised to 35° C. while stirring the solution. Then, the solution 2 was added to the solution containing copper powder dispersed therein, and was stirred for 30 minutes.

Thereafter, a solid content obtained by filtration was washed with ion-exchanged water until a transparent filtrate was obtained, and then, the washed solid content was vacuum-dried at 70° C. to obtain a copper powder coated with silver (a silver-coated copper powder).

The cross section of the silver-coated copper powder thus obtained was observed by means of the field emission scanning electron microscope (FE-SEM) by the same method as that in Comparative Example 1. It was found from the COMPO image of the cross section of the silver-coated copper powder in this observation that the copper powder was coated with silver in the silver-coated copper powder obtained in this comparative example.

Figure 16:
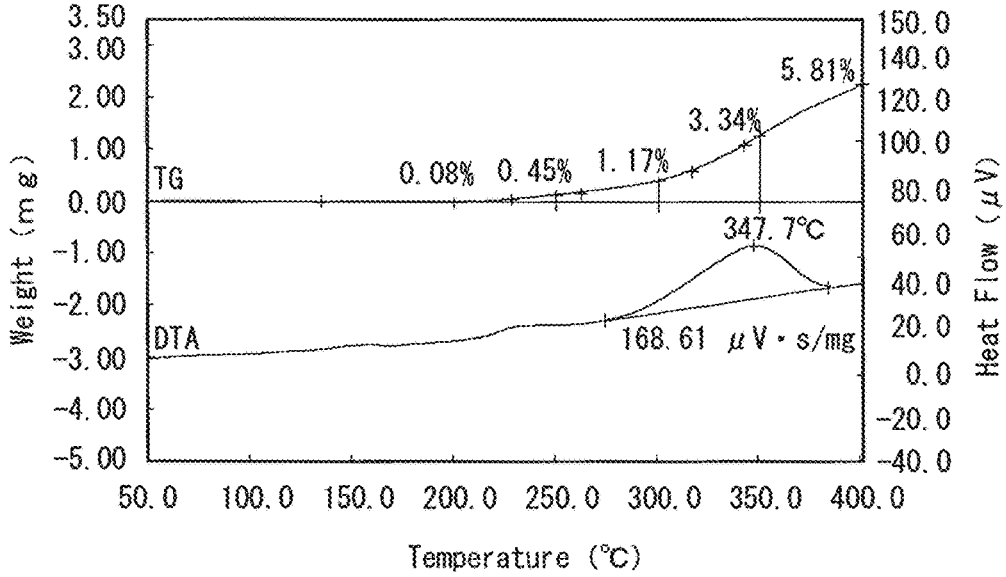
FIG. 16 is a chart showing the measured results in the TG-DTA of a silver-coated copper powder obtained in Comparative Example 4.

With respect to the obtained silver-coated copper powder, the TG-DTA measurement was carried out by the same method as that in Comparative Example 1. The measured results thereof are shown in FIG. 16. On the basis of a rate (%) of weight increase obtained from a difference (the weight increased by heating) between each of weights of the metal silver-coated copper powder obtained at temperatures of 200° C., 250° C., 300° C., 350° C. and 400° C. in this measurement and the weight of the silver-coated copper powder before heating, with respect to the weight of the silver-coated copper powder before heating, the storage stability (reliability) of the silver-coated copper powder was evaluated by evaluating the high-temperature stability (with respect to oxidation) of the silver-coated copper powder in air, assuming that all of the weights increased by heating were weights increased by oxidation of the silver-coated copper powder. As a result, the rates of weight increase at 200° C., 250° C., 300° C., 350° C. and 400° C. were 0.08%, 0.45%, 1.17%, 3.34% and 5.81%, respectively. It can be seen from these results that the high-temperature stability (with respect to oxidation) of the silver-coated copper powder in air is inferior to that of the metal composite powders obtained in Examples 1 and 2, so that the storage stability (reliability) of the silver-coated copper powder is inferior to that of the metal composite powders obtained in Examples 1 and 2, since the rates of weight increase at high temperatures in the silver-coated copper powder obtained in this comparative example are larger than those in the metal composite powders obtained in Examples 1 and 2.

Then, the image analysis of the cross section of the silver-coated copper powder in this comparative example was carried out by the same method as that in Example 1. As a result, the percentage of silver with respect to the whole cross-sectional area of the silver-coated copper powder (the amount of silver on the cross section) was 7.73% which was smaller than the content of silver (20.02%) (which was obtained by the same method as that in Comparative Example 2).

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A metal composite powder comprising:

a copper powder; and silver diffusing in grain boundaries of copper on the inside of the copper powder to one-third or more the particle diameter of the copper powder from the surface of the copper powder and coating the whole surface of the copper powder.

2. A metal composite powder as set forth in claim 1, wherein said copper powder has an average particle diameter of 0.1 to 100 μm.

3. A metal composite powder as set forth in claim 1, wherein the content of silver with respect to said metal composite powder is not less than 5% by weight.

4. A metal composite powder as set forth in claim 1, wherein the percentage of an area occupied by silver on a cross section of said metal composite powder is 3 to 20%.

5. A metal composite powder comprising:

a copper powder; and silver diffusing in the whole grain boundaries of copper on the inside of the copper powder and coating the whole surface of the copper powder.

6. A metal composite powder as set forth in claim 5, wherein said copper powder has an average particle diameter of 0.1 to 100 μm.

7. A metal composite powder as set forth in claim 5, wherein the content of silver with respect to said metal composite powder is not less than 5% by weight.

8. A metal composite powder as set forth in claim 5, wherein the percentage of an area occupied by silver on a cross section of said metal composite powder is 3 to 20%.

* * * * *